US009440284B2

(12) United States Patent
Sarh et al.

(10) Patent No.: US 9,440,284 B2
(45) Date of Patent: Sep. 13, 2016

(54) RIVETING TOOL AND METHOD WITH ELECTROMAGNETIC BUCKING BAR NORMALIZATION

(71) Applicant: The Boeing Company, Chicago, IL (US)

(72) Inventors: Branko Sarh, Huntington Beach, CA (US); David H. Amirehteshami, Rossmoor, CA (US); Rodney S. Wright, Glendale, AZ (US); Harinder Oberoi, Snohomish, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/988,910

(22) Filed: Jan. 6, 2016

(65) Prior Publication Data

US 2016/0114382 A1 Apr. 28, 2016

Related U.S. Application Data

(62) Division of application No. 13/343,106, filed on Jan. 4, 2012, now Pat. No. 9,259,779.

(51) Int. Cl.

| | |
|---|---|
| ***B21J 15/02*** | (2006.01) |
| ***B21J 15/32*** | (2006.01) |
| ***B21J 15/40*** | (2006.01) |
| *B21J 15/36* | (2006.01) |

(52) U.S. Cl.

CPC ..... *B21J 15/02* (2013.01); *B21J 15/32* (2013.01); *B21J 15/40* (2013.01); *B21J 15/36* (2013.01)

(58) Field of Classification Search

CPC ..... B21J 15/40; B21J 15/42; B21J 15/00; B21J 15/02; B21J 15/18; B21J 15/20; B21J 15/32; B21J 5/00

See application file for complete search history.

(56) References Cited

U.S. PATENT DOCUMENTS

| | | | | | |
|---|---|---|---|---|---|
| 2,347,399 | A * | 4/1944 | Croyle | B21J 15/36 | 72/466.5 |
| 3,934,330 | A * | 1/1976 | Briles | B21J 15/10 | 29/243.54 |
| 4,380,923 | A * | 4/1983 | Emmerich | B21J 15/18 | 29/243.54 |
| 4,830,923 | A * | 5/1989 | Sumiya | G11B 5/7022 | 427/128 |
| 4,995,148 | A * | 2/1991 | Bonomi | B21J 15/10 | 29/26 A |
| 5,588,323 | A * | 12/1996 | Peterson | B21J 15/30 | 72/466.5 |
| 7,047,786 | B2 * | 5/2006 | Easterbrook | B21J 5/00 | 72/334 |
| 8,327,514 | B2 * | 12/2012 | Kim | B21J 5/00 | 264/249 |
| 8,490,955 | B2 * | 7/2013 | Sarh | B21J 15/14 | 269/17 |
| 9,259,779 | B2 * | 2/2016 | Sarh | B21J 15/02 | |
| 2006/0117547 | A1 * | 6/2006 | Ffield | B21J 15/02 | 29/525.06 |

* cited by examiner

*Primary Examiner* — Moshe Wilensky
*Assistant Examiner* — Pradeep C Battula
(74) *Attorney, Agent, or Firm* — Walters & Wasylyna LLC

(57) ABSTRACT

A riveting tool including a magnet, a magnetically attractive housing, a non-magnetically attractive bucking bar received in the housing, the bucking bar being moveable relative to the housing along a bucking bar axis, and an actuation mechanism to move the bucking bar along the bucking bar axis.

13 Claims, 7 Drawing Sheets

RIVETING TOOL AND METHOD WITH ELECTROMAGNETIC BUCKING BAR NORMALIZATION

PRIORITY

This application is a divisional of U.S. Ser. No. 13/343,106 (now U.S. Pat. No. 9,259,779) filed on Jan. 4, 2012, the entire contents of which are incorporated herein by reference.

FIELD

This application relates to devices and methods for installing rivets or other fasteners through workpieces such as, but not limited to, aircraft fuselage structural pieces and the like. More particularly, this application relates to devices and methods for normalizing the striking angle upon a rivet and absorbing impact created by the forming of rivets through workpieces.

BACKGROUND

The installation of rivets and other types of high-strength fasteners in large structures, such as aircraft fuselage structural pieces and the like, is typically performed manually by two workers working in conjunction with each other on either side of a workpiece. A rivet is placed through a hole in the workpiece, which typically has a diameter slightly greater than the diameter of the rivet. Then, one worker operates a hammering tool that strikes the rivet head, while a second worker stands on the opposite side of the workpiece and pushes a bucking bar against the tail end of the rivet in the opposite direction. When the hammering tool strikes the head of the rivet, it provides a series of high impulse forces that cause the rivet tail to spread apart against the bucking bar, which acts similar to an anvil. The result is the formation of a tail end that tightly lodges the rivet within the workpieces, thus providing a high-strength bond between workpieces.

This manual installation process presents a twofold problem. First, it is difficult to maintain bucking bar normality with respect to the rivet axis to ensure that the rivet tail is properly formed. A misshapen tail end is costly to rework. Second, the hammering process is ergonomically difficult to the worker handling the bucking bar, as the worker's body is forced to absorb the vibrations caused by the hammering.

Present solutions to these problems typically eliminate workers in the process by involving computer controlled, automated riveting systems such as C-frame riveting machines or robotic systems with multi-function end effectors conducting a dual synchronous riveting process. However, these systems are costly, difficult to implement, and sometimes are not large enough to handle outsized workpieces such as airplane fuselage panels. As such, there still exists a need for manual placement of rivets using workers, and thus an alternative approach to the manual riveting process is needed; one that allows for accurate bucking bar placement that is not ergonomically difficult for the worker.

SUMMARY

In one embodiment, disclosed is a riveting tool. The riveting tool may include a magnet, a magnetically attractive housing, a non-magnetically attractive bucking bar received in the housing, the bucking bar being moveable relative to the housing along a bucking bar axis, and an actuation mechanism to move the bucking bar along the bucking bar axis.

In another embodiment, disclosed is a method for shaping a rivet in a workpiece. The method may include the steps of (1) positioning a bucking bar assembly on a first side of the workpiece, the bucking bar assembly including a magnetically attractive housing and a non-magnetically attractive bucking bar received in the housing, (2) positioning a magnet on a second side of the workpiece, and (3) moving the bucking bar relative to the housing such that the bucking bar engages the rivet.

Other aspects of the disclosed riveting tool with electromagnetic bucking bar normalization and associated method for shaping a rivet in a workpiece will become apparent from the following detailed description, the accompanying drawings and the appended claims.

DETAILED DESCRIPTION

Figure 1:
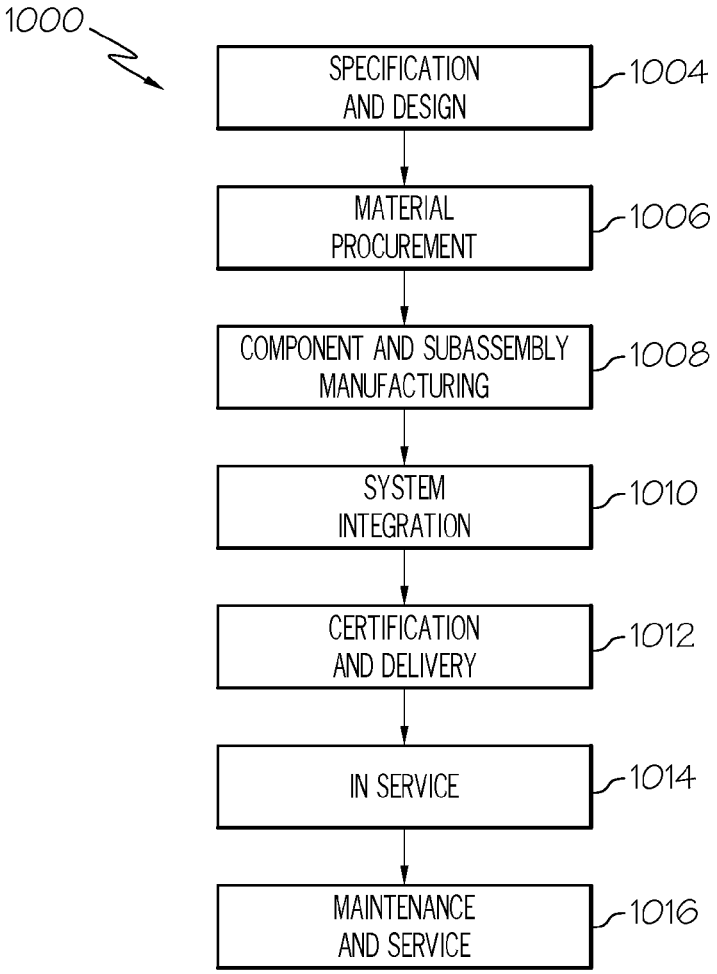
FIG. 1 is a flow diagram of aircraft production and service methodology.
Figure 2:
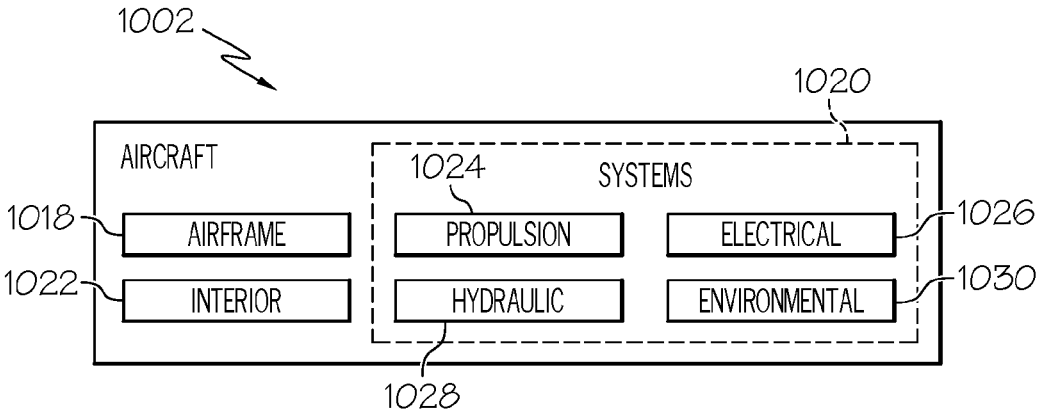
FIG. 2 is a block diagram of an aircraft.

Referring more particularly to the drawings, embodiments of the disclosure may be described in the context of an aircraft manufacturing and service method 1000 as shown in FIG. 1 and an aircraft 1002 as shown in FIG. 2. During pre-production, exemplary method 1000 may include specification and design 1004 of the aircraft 1002 and material procurement 1006. During production, component and subassembly manufacturing 1008 and system integration 1010 of the aircraft 1002 takes place. Thereafter, the aircraft 1002 may go through certification and delivery 1012 in order to be placed in service 1014. While in service by a customer, the aircraft 1002 is scheduled for routine maintenance and service 1016 (which may also include modification, reconfiguration, refurbishment, and so on).

Each of the processes of method 1000 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 2, the aircraft 1002 produced by exemplary method 1000 may include an airframe 1018 with a plurality of systems 1020 and an interior 1022. Examples of high-level systems 1020 include one or more of a propulsion system 1024, an electrical system 1026, a hydraulic system 1028, and an environmental system 1030. Any number of other systems may be included. Although an aerospace example is shown, the principles of the invention may be applied to other industries, such as the automotive industry.

Apparatus and methods embodied herein may be employed during any one or more of the stages of the production and service method 1000. For example, components or subassemblies corresponding to production process 1008 may be fabricated or manufactured in a manner similar to components or subassemblies produced while the aircraft 1002 is in service. Also, one or more apparatus embodiments, method embodiments, or a combination thereof may be utilized during the production stages 1008 and 1010, for example, by substantially expediting assembly of or reducing the cost of an aircraft 1002. Similarly, one or more of apparatus embodiments, method embodiments, or a combination thereof may be utilized while the aircraft 1002 is in service, for example and without limitation, to maintenance and service 1016.

Figure 3:
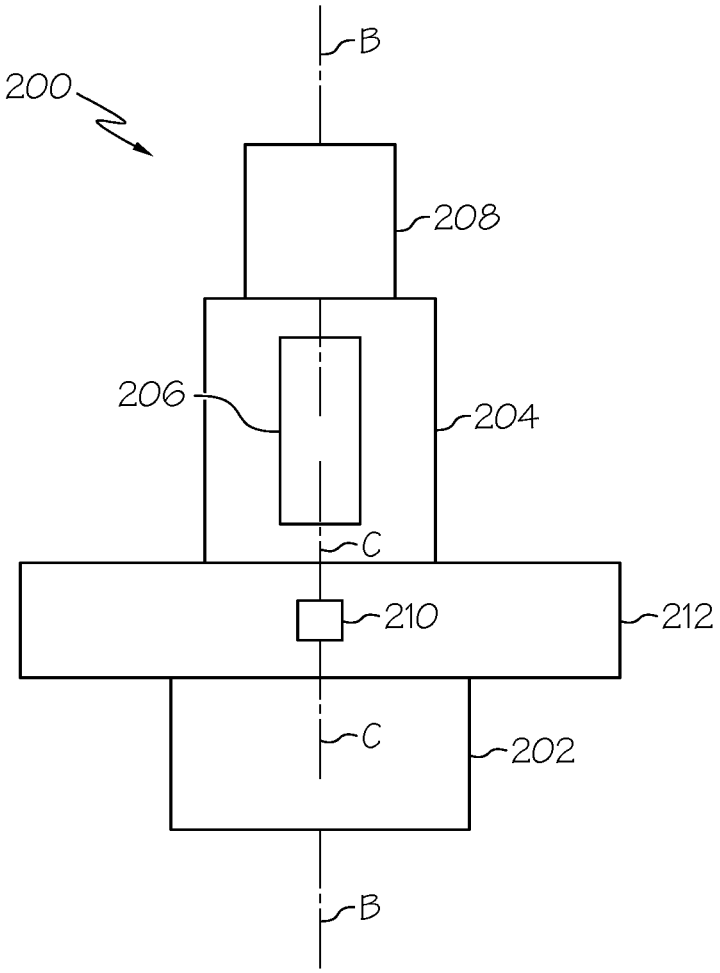
FIG. 3 is a functional block diagram of the disclosed riveting tool with electromagnetic bucking bar normalization.

Referring to FIG. 3, the disclosed riveting tool with electromagnetic bucking bar normalization, generally designated 200, may include a magnet 202, a magnetically attractive housing 204 and a bucking bar 206 moveably received in the housing 204. An actuation mechanism 208 may be operatively connected to the bucking bar 206 to move the bucking bar 206 relative to the housing 204 along a bucking bar axis B, and into engagement with a rivet 210 in a workpiece 212.

Thus, the magnetic attraction between the magnet 202 and the housing 204 may secure the housing 204 relative to the workpiece 212, and may substantially coaxially align the bucking bar axis B with the axis C of the rivet.

Figure 4:
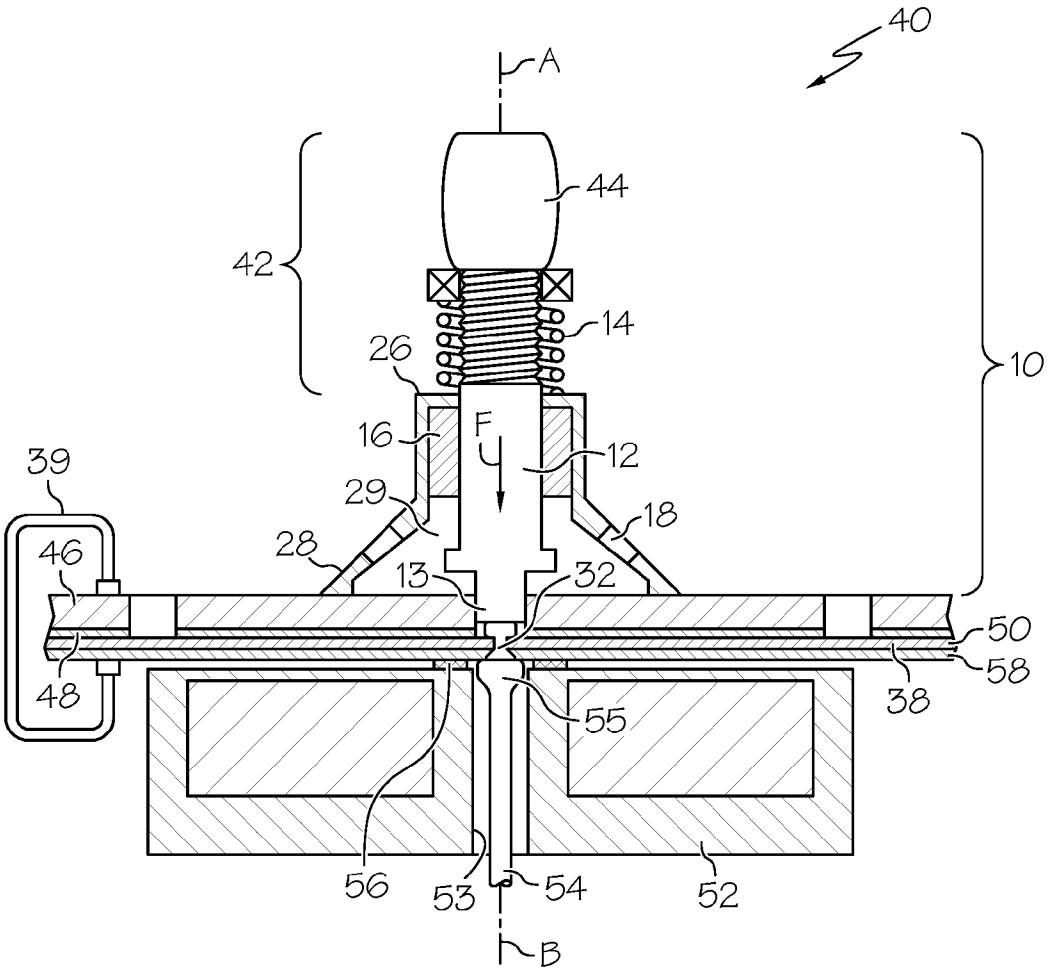
FIG. 4 is a side cross-sectional view of a first embodiment of the disclosed riveting tool with electromagnetic bucking bar normalization.

Referring to FIG. 4, a first embodiment of the disclosed riveting tool with electromagnetic bucking bar normalization, generally designated 40, may include a bucking bar assembly 10, a plate 46 and a magnet 52.

In the first embodiment, the bucking bar assembly 10 of the electromagnetic riveting tool 40 may be manually actuated. The bucking bar assembly 10 may include a bucking bar 12, a biasing element 14, an optional bearing 16, a housing 18 and a handle 44.

The housing 18 of the bucking bar assembly 10 may include a first end 26 longitudinally opposed from a second end 28. The housing 18 may define a chamber 29 that extends from the first end 26 to the second end 28. Optionally, the second end 28 of the housing 18 may be flared outward to increase the profile of the second end 28 of the housing 18, thereby providing greater stability of the bucking bar assembly 10 when the bucking bar assembly 10 is positioned on the plate 46.

The housing 18 may be formed from, or may include, a magnetic or magnetizable material. Examples of materials suitable for forming the housing 18 include, but are not limited to, iron, nickel, cobalt and mixtures thereof.

The bucking bar 12 of the bucking bar assembly 10 may be received in the chamber 29 defined by of the housing 18, and may define a bucking bar axis A. The bucking bar 12 may be moveable relative to the housing 18 through the chamber 29 along the bucking bar axis A.

The bucking bar 12 may be formed from one or more non-magnetic materials such that the bucking bar 12 does not interact with the magnetic field of the magnet 52. Examples of suitable non-magnetic materials include, but are not limited to, plastics, aluminum, composites, non-ferrous metals, and combinations thereof. At this point, those skilled in the art will appreciate that the material selected to form the bucking bar 12, or at least the working end 13 of the bucking bar 12, may be harder (e.g., may have a greater Vickers hardness) than the material used to form the rivet 32, thus ensuring that the rivet 32 is deformed when urged against the bucking bar 12.

The bearing 16 may be received in the chamber 29 of the housing 18. The bearing 16 may be positioned between the housing 18 and the bucking bar 12 to reduce friction as the bucking bar 12 moves relative to the housing 18, while ensuring that the bucking bar axis A remains relatively fixed as the bucking bar 12 moves relative to the housing 18. Therefore, to ensure straight, smooth movement of the bucking bar 12 relative to the housing 18, the bearing 16 may be a sliding, rolling or similar type bearing.

Figure 5:
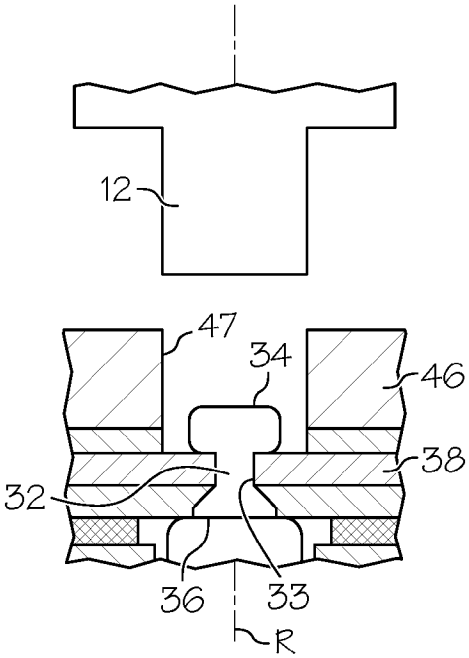
FIG. 5 is a side cross-sectional view of a portion of the riveting tool of FIG. 4, shown with the bucking bar in an inactive position.

The riveting tool 40 may be used to shape a rivet 32 in a workpiece 38. The workpiece 38 may define a first side 50 and a second side 58, and may include multiple separate workpiece members (two are shown in FIG. 4) that are to be connected together with the rivet 32. As shown in FIG. 5, the rivet 32 may extend through an opening 33 formed (e.g., drilled) in the workpiece 38, and may define a rivet axis R.

Referring to FIG. 5, an unformed rivet 32 having a tail end 34 and a head end 36 may be inserted through the predrilled (and optionally pre-countersunk) opening 33 in the workpiece 38. Then, during the rivet forming process, the tail end 34 of the rivet 32 may be compressed by the bucking bar 12 and the head end 36 of the rivet 32 may be compressed by the hammering tool 54.

The plate 46 may be positioned on the first side 50 of the workpiece 38. As shown in FIG. 5, the plate 46 may define an opening 47, which may be used to access the rivet 32 during the rivet forming process. The plate 46 may be securely connected to the workpiece 38 to hold the workpiece 38 together and eliminate any gaps within the workpiece 38. The magnetic attraction between the magnet 52 and the bucking bar assembly 10 may secure the plate 46 on the workpiece 38. Optionally, a clamp 39 (FIG. 4) or other suitable fastening apparatus or technique may be used to reinforce the connection between the plate 46 and the workpiece 38.

The plate 46 may be formed from or may include a magnetic or magnetizable material such that the plate 46 is attracted to the magnet 52. For example, the plate 46 may be formed from or may include iron, steel, nickel and/or cobalt. Optionally, the plate 46 may have a rubber coating 48, which may absorb vibrations during the riveting process and may minimize or eliminate damage to the surface of the workpiece 38.

The magnet 52 may be positioned on the second side 58 of the workpiece 38, and may define an opening 53 that extends therethrough to provide access to the rivet 32 during the rivet forming process. The magnet 52 may be securely affixed to the second side 58 of the workpiece 38 due to magnetic attraction between the magnet 52 and the plate 46.

Optional bushings 56 may be positioned between the workpiece 38 and the magnet 52. The bushings 56 may be of any suitable composition recognized by persons skilled in the art, and may generally serve to absorb vibrations caused during the rivet forming process.

The magnet 52 may be any magnet that produces a magnetic field having sufficient strength to hold the bucking bar assembly 10 on the plate 46. For example, the magnet 52 may be a permanent magnet (i.e., a magnet that constantly produces a magnetic field) or an electromagnet (i.e., a magnet that produces a magnetic field when an electric current is passing therethrough).

The riveting tool 40 may further include a hammering tool 54. The hammering tool 54 may be a tool capable of delivering a series of repeated high impulse forces upon the rivet 32, thus pushing the rivet 32 through the opening 33 in the workpiece 38 and into engagement with the bucking bar 12. The hammering tool 54 may extend through the opening 53 in the magnet 52 to engage the rivet 32. The opening 53 may be configured such that the axis B of the hammering tool 54 is substantially aligned with the axis R of the rivet 32.

The hammering tool 54 may be formed from one or more non-magnetic materials such that the hammering tool 54 does not interact with the magnet 52 when it is received in the opening 53. Examples of suitable non-magnetic materials include, but are not limited to, plastics, composites, aluminum, non-ferrous metals, and combinations thereof. At this point, those skilled in the art will appreciate that the material selected to form the hammering tool 54, or at least the working end 55 (FIG. 4) of the hammering tool 54, may be harder (e.g., may have a greater Vickers hardness) than the material used to form the rivet 32, thus ensuring that the rivet 32, as opposed to the hammering tool 54, is deformed when the hammering tool 54 strikes the rivet 32.

The bucking bar assembly 10 may be positioned over the plate 46 on the first side 50 of the workpiece 38 such that the second end 28 of the housing 18 is in abutting engagement with the plate 46. The magnetic attraction between the housing 18 and the magnet 52 may secure the bucking bar assembly 10 onto the plate 46.

Thus, prior to introducing the bucking bar assembly 10 to the magnetic field of the magnet 52, the bucking bar assembly 10 may be positioned over the opening 47 in the plate 46 such that the axis A of the bucking bar 12 is substantially aligned with the opening 47 and, ultimately, with the axis R of the rivet 32. Once the bucking bar assembly 10 is properly aligned over the opening in the plate 46, the magnet 52 may be introduced/actuated such that the magnetic attraction between the housing 18 and the magnet 52 secures the bucking bar assembly 10 in the substantially aligned configuration, thereby ensuring that the bucking bar 12 is substantially normal to the rivet 32 during the rivet forming process.

The biasing element 14 and the handle 44 may form the actuation mechanism 42 of the bucking bar assembly 10. The biasing element 14 may be positioned proximate the first end 26 of the housing 18, and may interact with the bucking bar 12 to urge the bucking bar toward the first end 26 of the housing 18 and out of engagement with the rivet 32 (i.e., the disengaged configuration), as shown in FIG. 5. In one particular construction, the biasing element 14 may be a spring coaxially received over the bucking bar 12 to urge the bucking bar 12 to the disengaged configuration.

When a force F sufficient to overcome the biasing force of the biasing element 14 is applied to the handle 44 of the actuation mechanism 42, the bucking bar 12 may be urged into engagement with the rivet 32 (i.e., the engaged configuration), as shown in FIG. 4. Therefore, during the rivet forming process, a user may manually apply the necessary force F to the handle 44 of the actuation mechanism 42. With the force F applied, the hammering tool 54 may be actuated until a desired rivet tail geometry has been achieved.

In an alternative embodiment, the force F may be applied automatically rather than manually. For example, the force F may be applied using a pneumatic actuation mechanism (discussed below).

Accordingly, the disclosed riveting tool 40 may employ a magnetic field established by the magnet 52 to secure the bucking bar assembly 10 relative to the workpiece 38, thereby ensuring substantial normality of the bucking bar axis A to the axis R of the rivet 32 during the rivet forming process.

Figure 6:
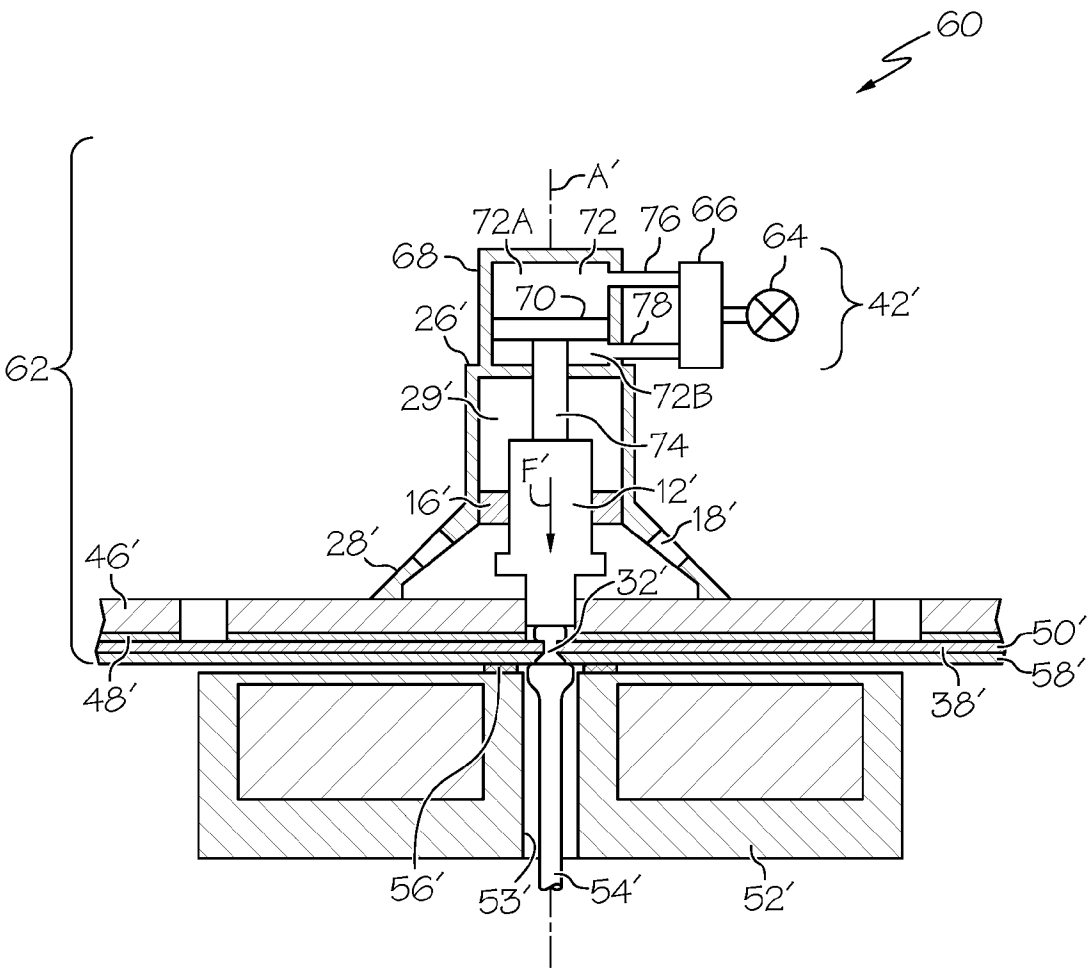
FIG. 6 is a side cross-sectional view of a second embodiment of the disclosed riveting tool, shown with a bucking bar in an active position.

Referring to FIG. 6, a second embodiment of the disclosed riveting tool with electromagnetic bucking bar normalization, generally designated 60, may include a bucking bar assembly 62, a plate 46' and a magnet 52'. The bucking bar assembly 62 may include a bucking bar 12', an optional bearing 16', a housing 18' and a pneumatic actuation mechanism 42'.

Like riveting tool 40, riveting tool 60 may employ a magnetic field established by the magnet 52' to secure the bucking bar assembly 62 relative to the workpiece 38', thereby ensuring substantial normality of the bucking bar axis A' to the axis W of the rivet 32' during the rivet forming process. However, while riveting tool 40 requires manually applying force F to the bucking bar 12, riveting tool 60 may employ air pressure to apply force F' to the bucking bar 12' during the rivet forming process.

Other techniques for automating the application of force F' to the bucking bar 12' are also contemplated. For example, the force F' may be applied to bucking bar 12' using a hydraulic actuation mechanism, an electromechanical actuation mechanism or a robot.

The housing 18' may be formed from a magnetic material, and may include a first end 26' longitudinally opposed from a second end 28'. The housing 18' may define a chamber 29' that extends from the first end 26' to the second end 28'. Optionally, the second end 28' of the housing 18' may be flared outward to increase the profile of the second end 28', thereby stabilizing the bucking bar assembly 62 when the bucking bar assembly 62 is positioned on the plate 46'.

The bucking bar 12' of the bucking bar assembly 62 may be receiving in the chamber 29' defined by of the housing 18', and may define a bucking bar axis A'. The bucking bar 12' may be moveable relative to the housing 18' through the chamber 29' along the bucking bar axis A'.

The bearing 16' may be received in the chamber 29' of the housing 18'. The bearing 16' may be positioned between the housing 18' and the bucking bar 12' to reduce friction as the bucking bar 12' moves relative to the housing 18', while ensuring that the bucking bar axis A' remains relatively fixed as the bucking bar 12' moves relative to the housing 18'.

Figure 7:
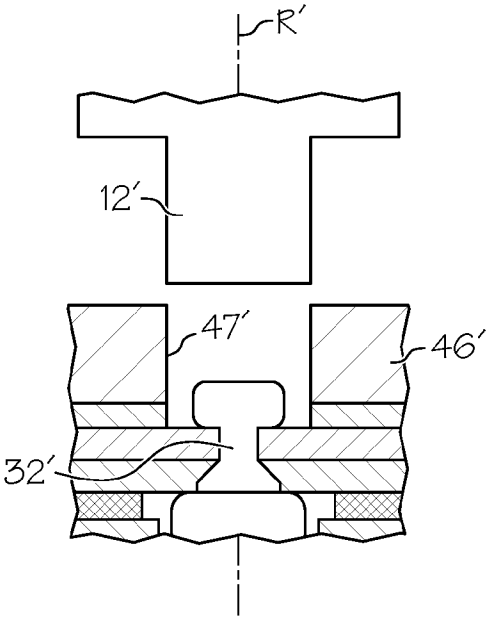
FIG. 7 is a side cross-sectional view of a portion of the riveting tool of FIG. 6, shown with the bucking bar in an inactive position.

The plate 46' may be positioned on the first side 50' of the workpiece 38'. As shown in FIG. 7, the plate 46' may define an opening 47', which may be used to access the rivet 32' during the rivet forming process.

The magnet 52', which may be an electromagnet, may be positioned on the second side 58' of the workpiece 38', and may define an opening 53' that extends therethrough to provide access to the rivet 32' during the rivet forming process. The magnet 52' may be securely affixed to the second side 58' of the workpiece 38' due to magnetic attraction between the magnet 52' and the plate 46' and/or the housing 18'. Optional bushings 56' may be positioned between the workpiece 38' and the magnet 52'.

The riveting tool 60 may further include a hammering tool 54'. The hammering tool 54' may extend through the opening 53' in the magnet 52' to engage and shape the rivet 32'.

The bucking bar assembly 62 may be positioned over the plate 46' on the first side 50' of the workpiece 38' such that the second end 28' of the housing 18' is in abutting engagement with the plate 46'. The magnetic attraction between the housing 18' and the magnet 52' may secure the bucking bar assembly 62 onto the plate 46'.

Thus, prior to introducing the bucking bar assembly 62 to the magnetic field of the magnet 52', the bucking bar assembly 10 may be positioned over the opening 47' in the plate 46' such that the axis A' of the bucking bar 12' is substantially aligned with the opening 47' and, ultimately, with the axis R' (FIG. 7) of the rivet 32'. Once the bucking bar assembly 62 is substantially aligned over the opening 47' in the plate 46, the magnet 52' may be introduced/actuated such that the magnetic attraction between the housing 18' and the magnet 52' secures the bucking bar assembly 62 in the substantially aligned configuration, thereby ensuring that the bucking bar 12' is substantially normal to the rivet 32' during the rivet forming process.

The actuation mechanism 42' may be a pneumatic actuation mechanism, and may include a pressure gauge 64, a valve 66, a housing 68 and a piston 70. The housing 68 may define a chamber 72. The piston 70 may be closely and slidably received in the chamber 72 to divide the chamber 72 into a piston chamber 72A and a rod chamber 72B. A rod 74 may extend from the piston 70 to the bucking bar 12' such that movement of the piston 70 relative to the housing 68 results in corresponding movement of the bucking bar 12' relative to the housing 18'.

A first, inlet port 76 and a second, outlet port 78 may be in fluid communication with the chamber 72. Therefore, when the valve 66 is opened, the piston chamber 72A may be pressurized by way of the inlet port 76, thereby displacing the piston 70 and, therefore, axially urging the bucking bar 12' into engagement with the rivet 32 (i.e., to the engaged configuration) with a desired force F', as shown in FIG. 6. However, as the piston 70 is displaced to the point that the piston chamber 72A makes communication with the outlet port 78, the force F' may cease, thereby disengaging the bucking bar 12' from the rivet 32', as shown in FIG. 7.

The pressure gauge 64 may monitor the amount of air pressure within the chamber 72, and may communicate the data to the switch 66. The switch 66 may power on to allow more air into the chamber 72 and may power off to stop the flow of air into the chamber 72. A set of parameters may determine when the switch 66 should be in the on or off position, and such parameters may be appreciated by those skilled in the art.

Accordingly, the disclosed riveting tool 60 may employ a magnetic field established by the magnet 52' to secure the bucking bar assembly 62 relative to the workpiece 38', thereby ensuring that the bucking bar axis A is substantially coaxially aligned with the axis R of the rivet 32' during the rivet forming process. Additionally, the actuation mechanism 42' may utilize air pressure to urge the bucking bar 12' against the rivet 32' during the rivet forming process.

Figure 9:
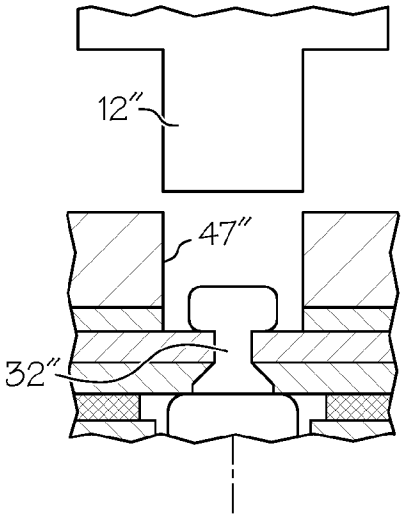
FIG. 9 is a side cross-sectional view of a portion of the riveting tool of FIG. 8, shown with the bucking bar in an inactive position.
Figure 8:
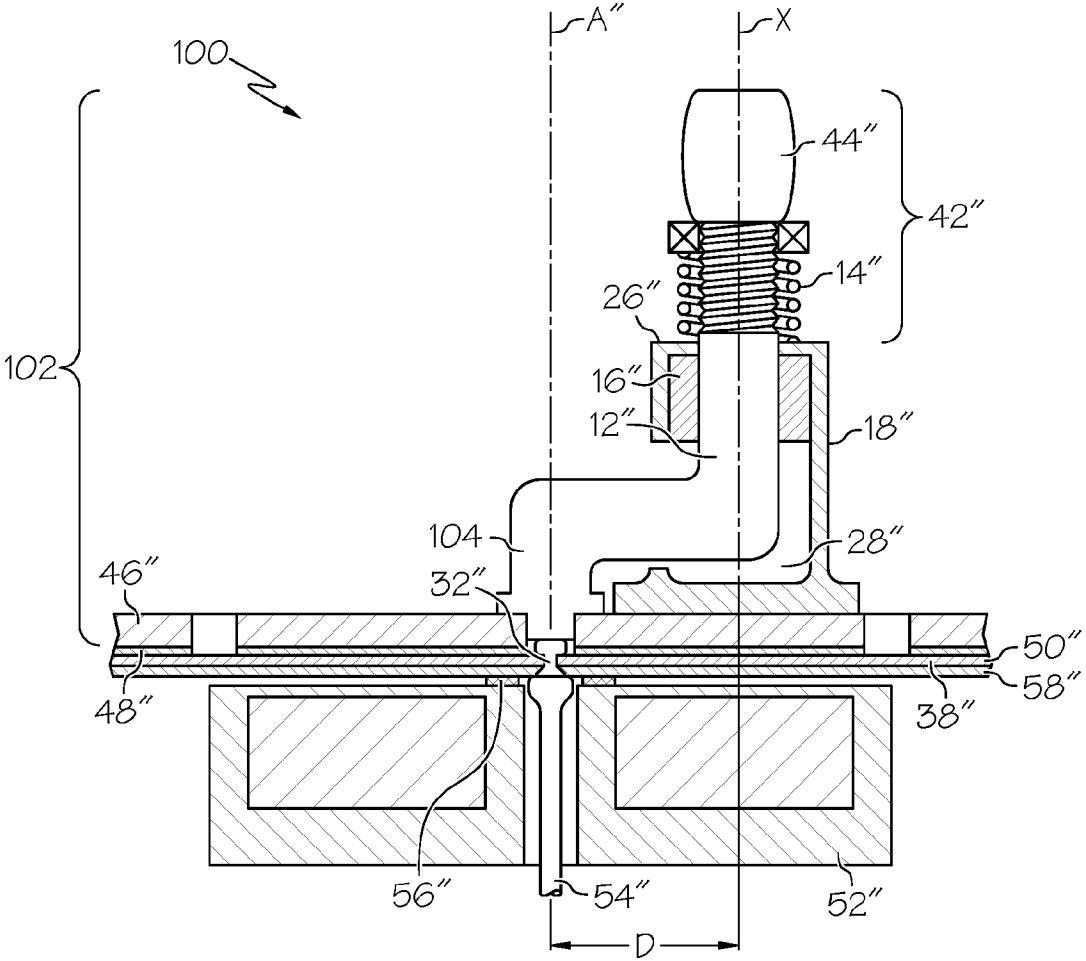
FIG. 8 is a side cross-sectional view of a third embodiment of the disclosed riveting tool, shown with a bucking bar in an active position.

Referring to FIGS. 8 and 9, a third embodiment of the disclosed riveting tool with electromagnetic bucking bar normalization, generally designated 100, may include a bucking bar assembly 102, a plate 46" and a magnet 52". In the third embodiment, the bucking bar assembly 102 may be manually actuated, similar to the bucking bar assembly 10 of the first embodiment. However, in the third embodiment, the housing 18" of the bucking bar assembly 102 may be offset from the working end 104 of the bucking bar 12" to access openings 47" that are difficult to otherwise reach, such as, for example, when there is limited vertical clearance above the access opening 47".

The bucking bar assembly 102 may include a bucking bar 12", a housing 18" and an actuation mechanism 42". The bucking bar 12" may include a ninety degree bend or curve such that the working end 104 of the bucking bar 12" and, thus, the bucking bar axis A" may be radially displaced a distance D from the longitudinal axis X of the housing 18".

The bucking bar axis A" may be substantially parallel with the longitudinal axis X of the housing 18". Therefore, the entire force applied to the bucking bar 12" may be translated into a substantially normal force applied to the rivet 32". However, non-parallel configurations are also contemplated.

The distance D between the bucking bar axis A" and the longitudinal axis X of the housing 18" may be of a sufficient magnitude to provide the required clearance, but may be minimized to minimize any bending moments within the bucking bar 12". The bucking bar 12" may be constructed from a suitably rigid material to minimize bending of the bucking bar 12" as a result of the offset of the bucking bar axis A" from the longitudinal axis X of the housing 18".

Thus, the housing 18" may sit at an offset position from the opening 47" defined by plate 46", thereby allowing the tool 100 to operate in tight or otherwise hard to reach places. Those skilled in the art will appreciate that the magnitude of the distance D may be dictated by the needs of a particular task.

Figure 10:
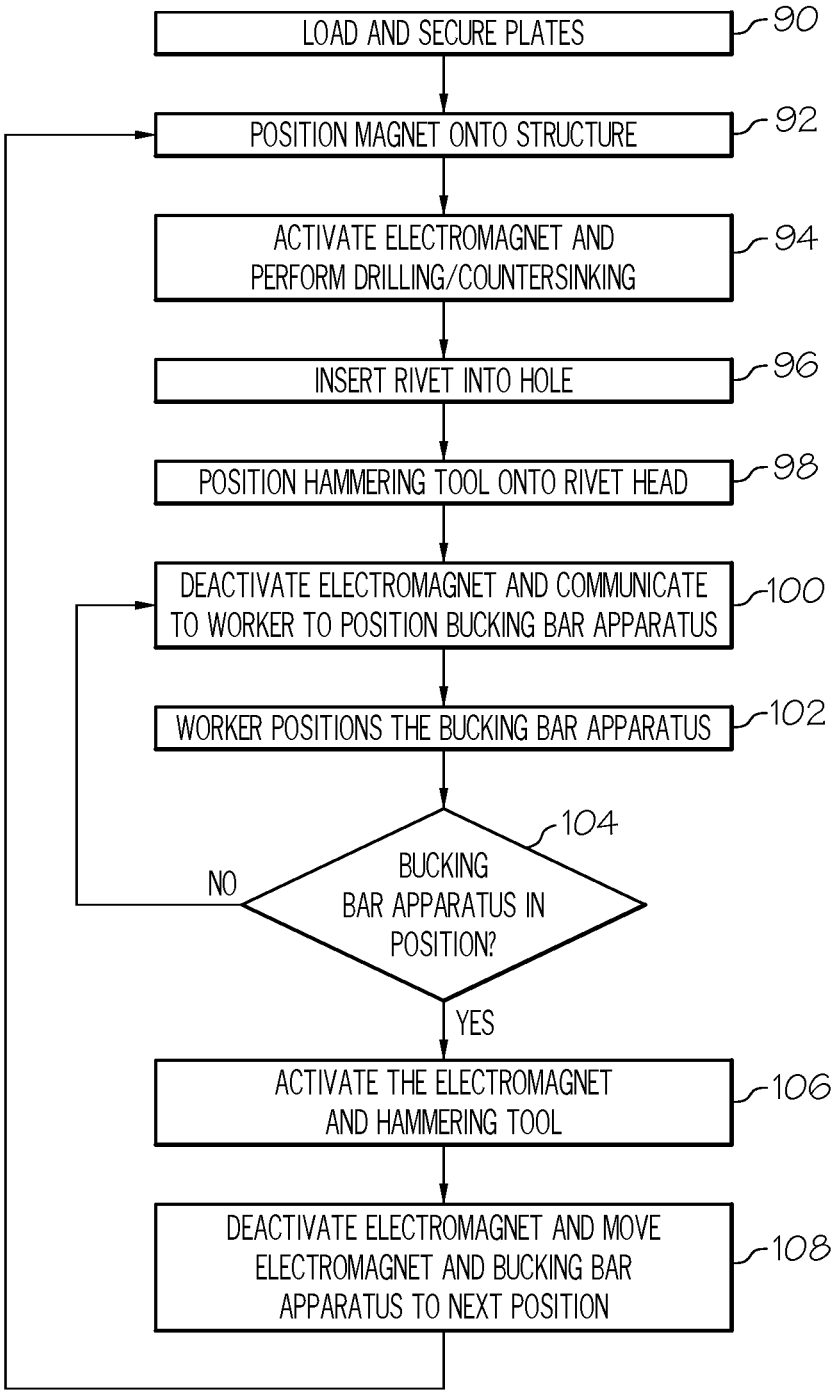
FIG. 10 is a flow chart depicting one embodiment of the disclosed riveting method.

FIG. 10 is a flow chart that depicts a first aspect of the disclosed method for using the disclosed riveting tool to install rivets in a workpiece. The method may employ an electromagnet such that the magnetic field may be easily activated and deactivated when desired, thereby simplifying assembly of the components of the tool.

First, as shown at block 90, the plate may be loaded and secured on the first side of the workpiece, and the magnet may be placed on the second side of the workpiece, as shown at block 92. Then, as shown at block 94, the magnet may be activated to secure the plate on the workpiece. With the plate and workpiece secured, a drilling or countersinking action may be performed to create the opening in the workpiece that will receive the rivet. The drilling and countersinking step may be skipped if the opening and countersink were pre-formed. Next, the rivet may be placed into the opening (block 96) and the hammering tool may be placed through the opening in the magnet so that it is in contact with the rivet head (block 98). The magnet may then be deactivated and it may be communicated to the worker to position the bucking bar assembly (block 100). The worker may then position the bucking bar assembly, as shown at block 102. If the bucking bar assembly is properly positioned (block 104), the worker may continue on to the next step (block 106); otherwise the worker returns to step 100. The magnet may once again be reactivated and the hammering tool may be used (block 106) to apply a hammering force upon the rivet until it is formed into the desired geometry within the workpieces. The magnet may then be deactivated again such that the apparatus may optionally be moved to another position (block 108) and the process may start over again.

Figure 11:
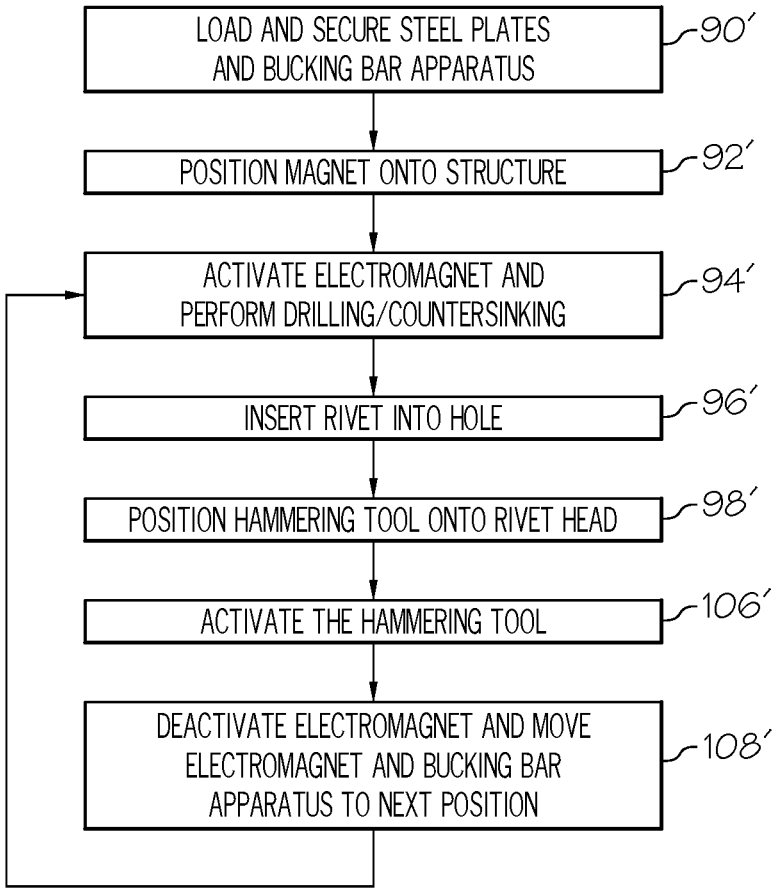
FIG. 11 is a flow chart depicting another embodiment of the disclosed riveting method.

FIG. 11 is a flow chart that depicts a second aspect of the disclosed method for using the disclosed riveting tool to install rivets in a workpiece. In the second aspect, the steps for deactivating and reactivating the magnet are not performed. First, the bucking bar assembly and plate may be positioned on the first side of the workpiece (block 90') and the magnet may be positioned on the second side of the workpiece (block 92'). Next, the magnet may be activated to secure the bucking bar assembly on the workpiece. Then, if the opening is not pre-formed, the drilling and/or countersinking actions may be performed to form the opening in the workpiece that will receive the rivet (block 94'). The rivet may then be inserted into the opening (block 96'). Then, the hammering tool may be placed through the magnet so that it may contact the rivet head (block 98'). The hammering tool may then be activated (block 106') to apply force upon the rivet until it is properly formed within the workpieces. Finally, the magnet may be deactivated and the tool may be moved to the next position (block 108') where the entire process may start over again.

Although various aspects of the disclosed riveting tool with electromagnetic bucking bar normalization have been shown and described, modifications may occur to those skilled in the art upon reading the specification. The present application includes such modifications and is limited only by the scope of the claims.

What is claimed is:

1. A method for shaping a rivet in a workpiece, said rivet having a rivet axis, said method comprising the steps of:

manually positioning a bucking bar assembly on a first side of said workpiece, said bucking bar assembly comprising a magnetically attractive housing and a non-magnetically attractive bucking bar received in said magnetically attractive housing;

positioning a magnet on a second side of said workpiece opposite said bucking bar assembly;

clamping said workpiece between said magnetically attractive housing and said magnet in response to magnetic attraction between said magnetically attractive housing and said magnet; and moving said non-magnetically attractive bucking bar relative to said magnetically attractive housing along a bucking bar axis defined by said bucking bar such that said non-magnetically attractive bucking bar engages said rivet.

2. The method of claim 1 further comprising the step of applying a biasing force to said bucking bar to bias said bucking bar away from said rivet.

3. The method of claim 2 wherein said step of moving said bucking bar relative to said housing comprises applying an actuation force to said bucking bar, said actuation force being greater than said biasing force.

4. The method of claim 1 wherein said rivet comprises a head end and a tail end.

5. The method of claim 4 further comprising the step of striking said head end with a hammering tool while said bucking bar engages said tail end.

6. The method of claim 1 wherein said magnet comprises an electromagnet.

7. The method of claim 6 further comprising the steps of:

substantially coaxially aligning said bucking bar axis defined by said bucking bar and said rivet axis defined by said rivet; and actuating said electromagnet when said bucking bar axis defined by said bucking bar is substantially coaxially aligned with said rivet axis defined by said rivet, wherein said magnetic attraction between said magnetically attractive housing and said magnet maintains said bucking bar axis substantially coaxially aligned with said rivet axis.

8. The method of claim 1 further comprising the step of positioning a plate between said workpiece and said bucking bar assembly, said plate defining a plate-opening therein having a plate-opening axis, said plate-opening axis being substantially coaxially aligned with said bucking bar axis, wherein said non-magnetically attractive bucking bar is received within said plate-opening when engaging said rivet.

9. The method of claim 8 further comprising the step of drilling a hole in said workpiece, wherein said drilling step if performed through said opening defined by said plate.

10. The method of claim 9 further comprising the step of positioning said rivet in said hole after said drilling step.

11. The method of claim 1 wherein said magnet defines a magnet-opening therein having a magnet-opening axis extending through said magnet, and wherein said magnet-opening axis is substantially coaxially aligned with said rivet axis and receives a hammering tool.

12. The method of claim 11 wherein said magnetically attractive housing positions said bucking bar axis in coaxial alignment with said magnet-opening axis, and wherein said magnetic attraction between said magnetically attractive housing and said magnet maintains said bucking bar axis substantially coaxially aligned with said magnet-opening axis.

13. The method of claim 1 further comprising the steps of:

substantially coaxially aligning said bucking bar axis defined by said bucking bar and said rivet axis defined by said rivet; and substantially coaxially aligning a magnet-opening axis defined by a magnet-opening formed through said magnet and said rivet axis defined by said rivet, wherein said magnetic attraction between said magnetically attractive housing and said magnet maintains substantially coaxially alignment of said bucking bar axis, said rivet axis and said magnet-opening axis.

* * * * *